US006593894B1

(12) United States Patent
Biswas et al.

(10) Patent No.: US 6,593,894 B1
(45) Date of Patent: Jul. 15, 2003

(54) HIGHLY DIRECTIONAL RECEIVER AND SOURCE ANTENNAS USING PHOTONIC BAND GAP CRYSTALS

(75) Inventors: Rana Biswas, Ames, IA (US); Gary L. Tuttle, Ames, IA (US); Ekmel Ozbay, Bilkent (TK); Burak Temelkuran, Bilkent (TK); Mihail Sigalas, Santa Clara, CA (US); Kai Ming Ho, Ames, IA (US)

(73) Assignee: Iowa State University Research Foundation, Ames, IA (US)

( * ) Notice: Subject to any disclaimer, the term of this patent is extended or adjusted under 35 U.S.C. 154(b) by 26 days.

(21) Appl. No.: 09/961,791

(22) Filed: Sep. 24, 2001

Related U.S. Application Data

(60) Provisional application No. 60/235,497, filed on Sep. 26, 2000.

(51) Int. Cl.[7] ..... H01Q 9/28

(52) U.S. Cl. ..... 343/793; 343/909; 343/789

(58) Field of Search ..... 343/700 MS, 702, 343/909, 789, 793

(56) References Cited

U.S. PATENT DOCUMENTS

| | | | | |
|---|---|---|---|---|
| 5,335,240 A | | 8/1994 | Ho et al. | 372/39 |
| 5,386,215 A | * | 1/1995 | Brown | 343/795 |
| 5,689,275 A | * | 11/1997 | Moore et al. | 343/909 |
| 6,274,293 B1 | | 8/2001 | Gupta et al. | 430/315 |

OTHER PUBLICATIONS

Gain Enhancement Methods For Printed Circuit Antennas, David R. Jackson and Nicolaos G. Alexopoulos, IEEE Transactions On Antennas And Propagation, vol. AP–33, No. 9, Sep. 1985.

Gain Enhancement Methods For Printed Circuit Antennas Through Multiple Superstrates, H.Y. Yang and Nicolaos G. Alexopoulos, IEE Transactions On Antennas And Propagation, vol. AP–35, No. 7, Jul. 1987.

A Leaky–Wave Analysis of the High–Gain Printed Antenna Configuration, David R. Jackson and Arthur A. Oliner, IEEE Transactions on Antennas And Propagation, vol. 36, No. 7, Jul. 1988.

Photonic Crystal–Based Resonant Antenna With A Very High Directivity, B. Temelkuran, Mehmet Bayindir, E. Ozbay, R. Biswas, M.M. Sigalas, G. Tuttle and K.M. Ho, Journal of Applied Physics, vol. 87, No. 1, Jan. 1, 2000.

Photonic Crystal Based Resonant Antenna With A Very High Directivity, Reprint Jul. 2000.

* cited by examiner

*Primary Examiner*—Michael C. Wimer
(74) *Attorney, Agent, or Firm*—Leydig, Voit & Mayer, Ltd.

(57) ABSTRACT

A directional antenna made with photonic band gap structures has been presented. The directional antenna is formed with two photonic band gap structures oriented back to back and separated from each other by a distance to form a resonant cavity between the photonic band gap structures. An antenna element is placed in the resonant cavity. The resonant frequency of the cavity is tuned by adjusting the distance between the photonic band gap structures. The resonant cavity can be asymmetrical or symmetrical.

24 Claims, 6 Drawing Sheets

FIG. 3
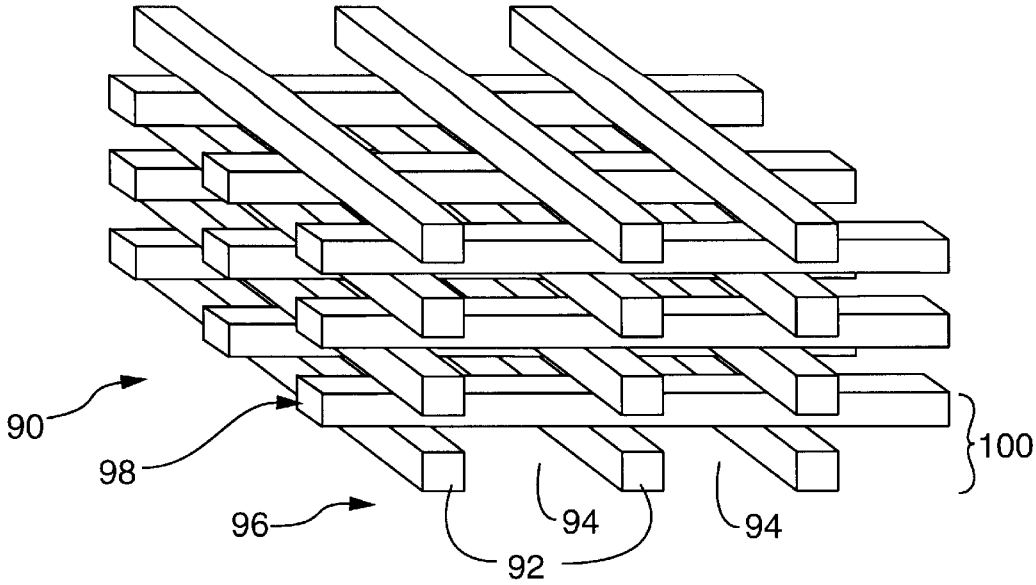
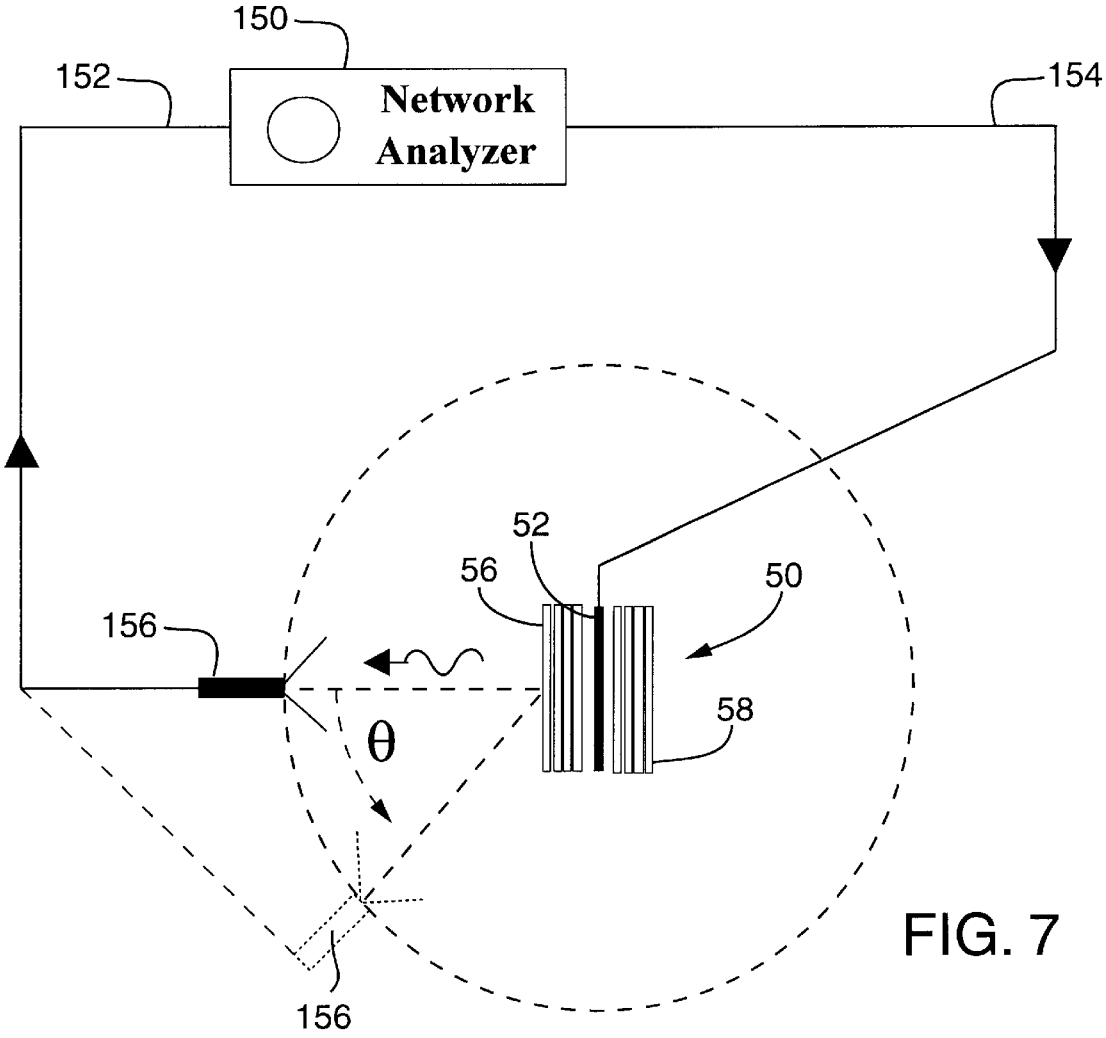
FIG. 7

HIGHLY DIRECTIONAL RECEIVER AND SOURCE ANTENNAS USING PHOTONIC BAND GAP CRYSTALS

CROSS-REFERENCE TO RELATED PATENT APPLICATIONS

This patent application claims the benefit of U.S. provisional patent application No. 60/235,497, filed Sep. 26, 2000.

STATEMENT REGARDING FEDERALLY SPONSORED RESEARCH OR DEVELOPMENT

This invention was developed with government assistance under DOE Contract No. W-7405-Eng-82 and DOC Grant No. ITA87-02. The government may have certain rights in this invention.

FIELD OF THE INVENTION

This invention relates to antennas, and more particularly to a directional antenna having a narrow angular range and a method of manufacturing same.

BACKGROUND OF THE INVENTION

The principal function of antennas is to radiate or receive radio waves (e.g., energy). In addition to transmitting or receiving waves, antennas in advanced systems are typically required to maximize or optimize the transmission/receiving in some directions and suppress it in other directions. These types of antennas are known as directional antennas.

Directivity, gain, and half-power beamwidth are parameters that are typically used to compare directional antennas. Directivity is defined as the ratio of the radiation intensity in a given direction from the antenna to the radiation intensity averaged over all directions from the antenna. Gain is defined as the ratio of the radiation intensity in a given direction to the radiation intensity that would have been obtained if the power was radiated isotropically (i.e., equal in all directions). The half-power beamwidth is the angle between the two directions in which the radiation intensity is one-half the maximum value of the beam. It is used to approximate the resolution capability of the antenna, which is the ability to distinguish between two sources.

Directional antennas are used in a wide variety of applications. These applications include satellite communications, wireless communications (e.g., cellular communications), surveillance, targeting, weather radar, flight controls, etc. The number of directional antennas in the world is increasing at tremendous rates as the number of applications for directional antennas increases. This growth is due in part to the recent explosive growth in wireless communications (e.g., cellular communications) that has been spurred in the United States by the U.S. Federal Communication Commission's approval of certain frequency bands for the next generation of Personal Communication Service ("PCS") devices.

One result of the proliferation in antennas is the increase in the number of antennas that pick up extraneous transmissions. One disadvantage is that the transmissions interfere with the applications that are using the antennas. Additionally, in the area of surveillance, other antennas can pick up the transmissions when the source antenna transmits over a wider half-power beamwidth than is necessary.

The industry has responded to the above issues by designing antenna systems with high directivity and low half-power beamwidths. A wide range of technologies and antenna types have been used to design systems having high directivity and low half-power beamwidths. One of these technologies that is used in antenna design is photonic band gap (PBG) structures.

Photonic band gap (PBG) structures are periodic dielectric structures that exhibit frequency regions in which electromagnetic waves cannot propagate. The interest in PBGs arises from the fact that photon behavior in a dielectric structure is similar to the behavior of electrons in a semiconductor. The periodic arrangement of atoms in a semiconductor lattice opens up forbidden gaps in the energy band diagram for the electrons. Similarly in all-dielectric PBG structures, the periodic placement of dielectric "atoms" opens up forbidden gaps in the photon energy bands.

The all-dielectric PBG structures behave as ideal reflectors in the band gap region. Metallic PBG structures consisting of isolated metal patches have a band-stop behavior very similar to the all-dielectric photonic band gap structures. Depending on the directional periodicity of these dielectric structures, the band gap may exist in 1-D, 2-D or all the three directions.

Antennas mounted on photonic crystal substrate surfaces have higher efficiency and directivity compared to conventional antennas on dielectric substrates. The primary reason for this is that radiation 204 (see FIG. 9) from an antenna 200 mounted on a dielectric substrate 202 flows through the dielectric substrate 200 at incident angles up to ±74 $_c$ while radiation 206 is trapped at incident angles beyond $\pm\theta_c$. $\theta_c$ is material dependent and it is the maximum angle of incidence where radiation flows through the substrate. On the other hand, no radiation flows through the photonic crystal substrates 208 in the band gap region as illustrated in FIG. 9*b*.

High directivities using array antennas on photonic crystals have been suggested. However, the maximum directivity that has been demonstrated using a photonic crystal-based single dipole antenna was 10 and the antenna had a radiative gain of 8. What is needed is a photonic based antenna with very high directivity and gain.

BRIEF SUMMARY OF THE INVENTION

It is an object of the instant invention to overcome at least some of the aforementioned and other known problems existing in the art. More particularly, it is an object of the instant invention to provide a method of manufacturing a photonic based antenna structure having high directivity. It is a further object of the instant invention to provide a method of manufacturing a photonic based antenna structure having a three-dimensional photonic band gap structure. Additionally, it is an object of the instant invention to provide a photonic based antenna system with a very high directivity.

In view of the above objects, it is a feature of the instant invention to provide a method of manufacturing highly directional antennas using photonic band gap structures which utilize simple cost effective construction. It is a further feature of the instant invention that the antennas are made from metallic photonic band gap structures. It is an additional feature of the instant invention that the antenna using photonic band gap structures has a high gain. It is a further feature of the instant invention that the method of manufacturing may be varied to adjust the transmission frequencies of the antennas based upon the spatial distance between photonic band gap structures.

In accordance with an embodiment of the instant invention, a method of manufacturing an antenna comprises the steps of: a) forming a first photonic band gap structure having a number of layers; b) forming a second photonic band gap structure having a greater number of layers than the first photonic band gap; c) forming a cavity by placing the first and second photonic band gap structures back to back and separated by a predetermined distance; d) placing an antenna element inside the cavity.

In one embodiment, the photonic band gap structure is formed with layers of dielectric rods stacked on top of each other, each layer having its axes oriented at 90° with respect to adjacent layers, alternate layers having their axes parallel to each other with the rods of one layer in offset between the rods of the other layer forming a three-dimensional structure of stacked layers having a four-layer periodicity, the dielectric rods arranged with parallel axes at a given spacing to form a planar layer and arranged in a material having a different and contrasting refractive index, the dimensions of the rods, the spacing between the rods and the refractive contrast of the materials selected to produce a photonic band gap at a given wavelength.

In another embodiment, the photonic band gap structure is formed with layers of metallic rods stacked on top of each other, each layer having its axes oriented at 90° with respect to adjacent layers, alternate layers having their axes parallel to each other forming a three-dimensional structure of stacked layers having a two-layer periodicity, the metallic rods arranged with parallel axes at a given spacing to form a planar layer and arranged in a material having a different and contrasting refractive index, the dimensions of the metallic rods, the spacing between the metallic rods and the refractive contrast of the materials selected to produce a photonic band gap at a given wavelength.

The metallic photonic band gap structure may also be formed by the steps of: a) spinning on a layer of dielectric to a first thickness on a GaAs substrate; b) imidizing this layer of dielectric; c) forming a metal pattern on the layer of dielectric; d) spinning on a second layer of dielectric to a second thickness on the metal pattern; e) imidizing this layer of dielectric; f) repeating steps c–e for each subsequent layer; and g) removing the substrate from the structure.

These and other aims, objectives, and advantages of the invention will become more apparent from the following detailed description while taken into conjunction with the accompanying drawings.

BRIEF DESCRIPTION OF THE DRAWINGS

FIG. 3 is a perspective view of a layer-by-layer metallic photonic band gap structure used in one embodiment of the present invention;

FIG. 7 is a block diagram of a test set-up used to measure radiation pattern, detected power, and reflected power for antennas made in accordance with the teachings of the instant invention;

Figure 1:
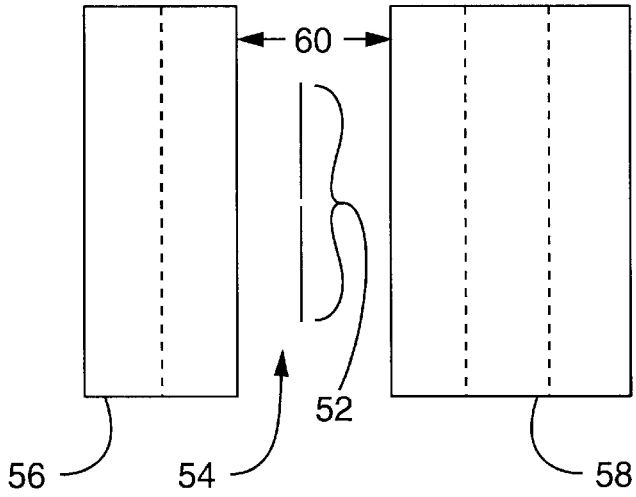
FIG. 1 is a block diagram view of an antenna in accordance with the instant invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, methods, and equivalents falling within the spirit and scope of the invention as defined by the appended claims.

DETAILED DESCRIPTION OF THE PREFERRED EMBODIMENT

This application describes successful design, fabrication and characterization of photonic band gap based antenna structures having high directivity and narrow half-power beamwidths. These antenna structures have uses as a highly directional source or receiver. As a source, the antenna structures have use in radar systems, flight control systems, ground to satellite communications, and satellite to satellite communications. When pointed at a receiver antenna, only the receiver can detect the signal. Alternatively, the antenna structures have use as a highly directional receiver and are able to detect and discriminate signals from a very narrow cone.

FIG. 1 shows a block diagram of a resonant antenna 50 constructed in accordance with the instant invention. The resonant antenna 50 has an antenna element 52 located in a resonant cavity 54 formed between photonic crystal structures 56, 58. While FIG. 1 shows the antenna element 52 as a dipole element, it is recognized that the antenna element 52 may comprise other types of antenna elements such as a monopole, ring sector, circular ring, elliptical, etc. and may be either horizontally or vertically oriented with respect to the elevation plane.

The radiation pattern of the antenna 50 is dependent on the configuration of the resonant cavity 54. If an asymmetrical cavity is used, the antenna 50 radiates in only in a forward direction. An asymmetrical cavity is formed by selecting one of the photonic crystal substrates 56, 58 to have a higher reflectivity than the other photonic crystal substrate. This is accomplished by forming one of the photonic crystal substrates 56, 58 with a lower number of unit cells so that one wall of the cavity 54 is thinner than the other wall. A unit cell comprises a group of layers of the photonic crystal structure that has a periodicity wherein the pattern of the crystal structure repeats itself with each group of layers. If a symmetrical cavity is used, the antenna 50 radiates in both a forward and backward direction. This is accomplished by forming the photonic crystal substrates 56, 58 with an equal number of unit cells. For example, FIG. 1 shows a cavity 54 with the configuration of photonic crystal structure 56 being a two unit cell and photonic crystal structure 58 being a three unit cell. Cavity 54 is an asymmetrical cavity. Other configurations where the cavity is asymmetrical are when one of the photonic crystal structures has a 1 unit cell and the other has 2 unit cells, one has 3 unit cells and the other has 4 unit cells, one has 2 unit cells and the other has 4 unit cells, etc.

The photonic crystal structures 56, 58 are separated by a distance 60. The resonant frequency of the cavity 54 is tuned by changing the distance 60. Increasing the distance 60 decreases the resonant frequency of the cavity 54 and decreasing the distance increases the resonant frequency of the cavity 54. The distance 60 is selected such that a defect mode is generated inside the frequency band gap of the photonic crystal structures 56, 58. This results in only a narrow frequency range transmitting through the cavity 54. The frequency of the wave that is transmitted through the cavity 54 is tuned by setting the distance 60 to an integer multiple of wavelengths inside the cavity 54. For example, if the photonic crystal structures 56, 58 have a band gap from 11 to 14 GHz, a distance 60 of 8 millimeters results in a defect mode at 12 GHz.

The dimensions of the antenna element 52 are selected so that they correspond to the resonant frequency of the cavity 54. For example, the length of the antenna element 52 is selected so that it is a fraction of wavelength at a frequency that is close to the resonance frequency of the cavity 54. Experimental measurements and simulation results indicate that the optimum placement of the antenna element 52 is towards the photonic crystal structure that has the larger number of unit cells (i.e., the back crystal). The antenna element 52 should be parallel to the rods 82, 92 (see FIG. 2 and FIG. 3) that are located at the surface of the back crystal to maximize the directivity and the detected power of the antenna 50.

The photonic crystal structures 56, 58 are generally made by forming a planar defect in a photonic crystal structure by separating layers of the structure. The photonic crystal structures 56, 58 are constructed using either a layer by layer all-dielectric structure (see FIG. 2) or a layer by layer metallic structure (see FIG. 3).

Figure 2:
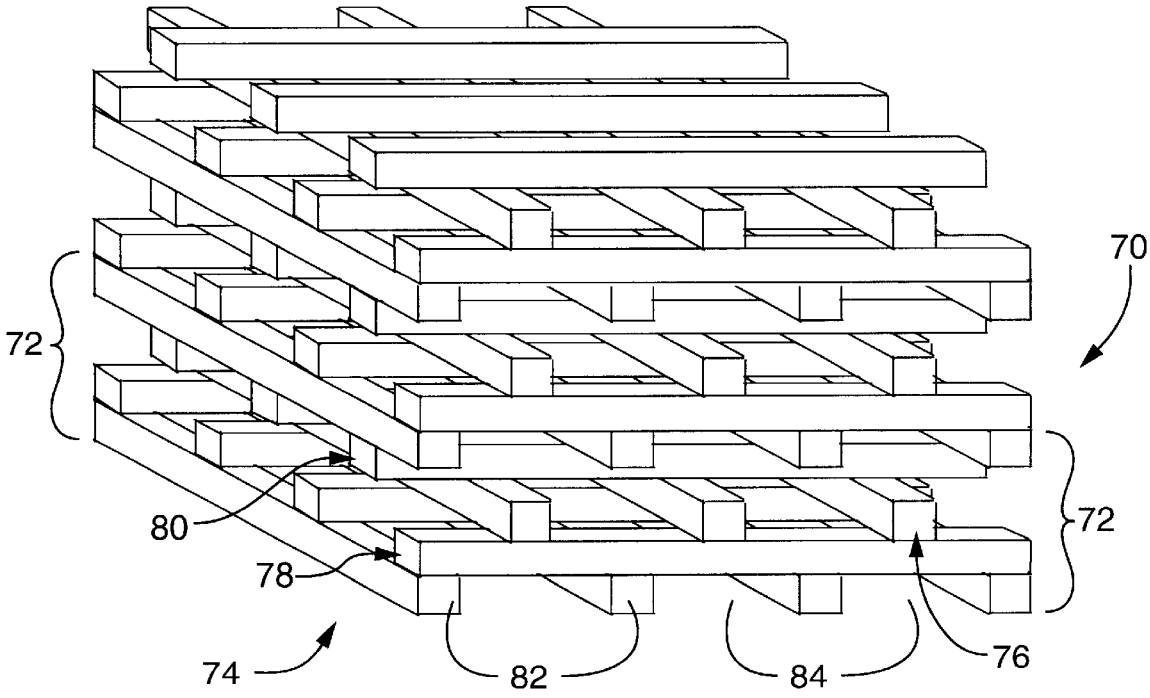
FIG. 2 is a perspective view of a layer-by-layer dielectric photonic band gap structure used in one embodiment of the present invention.

In one embodiment, the photonic crystal structures 56, 58 are constructed using a layer by layer dielectric photonic crystal structure 70 shown in FIG. 2. The construction of the photonic crystal structure is described in U.S. Pat. Nos. 5,335,240 and 5,406,573, which are hereby incorporated by reference in their entireties. The dielectric photonic crystal structure 70 has multiple layers of dielectric rods 82 stacked on top of each other and interspersed by material segments 84 that have a contrasting dielectric constant. Each layer has its axes oriented at 90° with respect to adjacent layers and alternate layers have their axes parallel to each other with the rods of one layer in offset between the rods of the other layer forming a three-dimensional structure of stacked layers having a four-layer periodicity. The four layer periodicity is illustrated in FIG. 2 by layers 74, 76, 78, 80 and each four layer group forms a unit cell 72. The dimensions of the dielectric rods 82, the spacing between the dielectric rods 82 and the refractive contrast of the dielectric rods 82 and material segments 84 are selected to produce a photonic band gap at a given wavelength as is known in the art. While FIG. 2 shows the dielectric photonic structure having a four layer periodicity, it is recognized that other dielectric photonic structures with different periodicities and with any number of layers can be used.

In another embodiment, the photonic crystal structures 56, 58 are a metallic photonic crystal structure 90 (see FIG. 3). Metallic photonic crystal structures 90 provide a higher rejection rate per layer than the dielectric photonic crystal structure and can be kept smaller than the minimum dimensions needed for a typical dielectric crystal. Additionally, fewer number of layers are needed to make an antenna 50 with similar directivity and gain values as an antenna 50 made with dielectric photonic crystal structures 70. The metallic photonic crystal structure 90 has multiple layers of metal rods 92 stacked on top of each other. The metal rods 92 are interspersed by segments 94 that have a contrasting dielectric constant. These segments 94 comprise air in one embodiment. Those skilled in the art will recognize that the segments 94 can be any dielectric material that contrasts with the metal rods 92. Each layer has its axes oriented at 90° with respect to adjacent layers and alternate layers have their axes parallel to each other forming a three-dimensional structure of stacked layers having a two-layer periodicity. The two layer periodicity is illustrated in FIG. 3 by layers 96, 98 and each two layer group forms a unit cell 100. The dimensions of the metal rods 92, the spacing between the metal rods 92, and the refractive contrast of the metal rods 92 and segments 94 are selected to produce a photonic band gap at a given wavelength as known by those skilled in the art. While FIG. 3 shows the metallic photonic structure having a two layer periodicity, it is recognized that other metallic photonic structures with different periodicities and with any number of layers can be used. For example, a stack of metallic grids could be used to build the metallic photonic structure. The resulting structure would have a one layer periodicity.

Figure 4A:
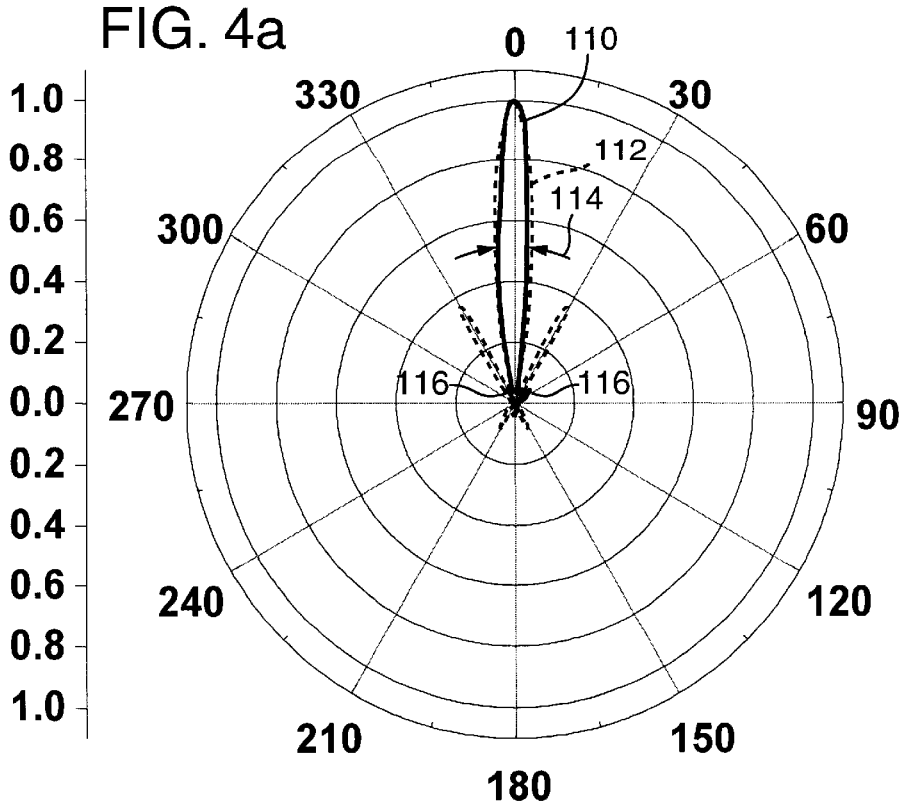
FIG. 4 is an illustration of measured and simulated radiation patterns in the H plane and the E plane for a dielectric based photonic crystal antenna structure made in accordance with the dielectric photonic band gap structure of FIG. 2.
Figure 4B:
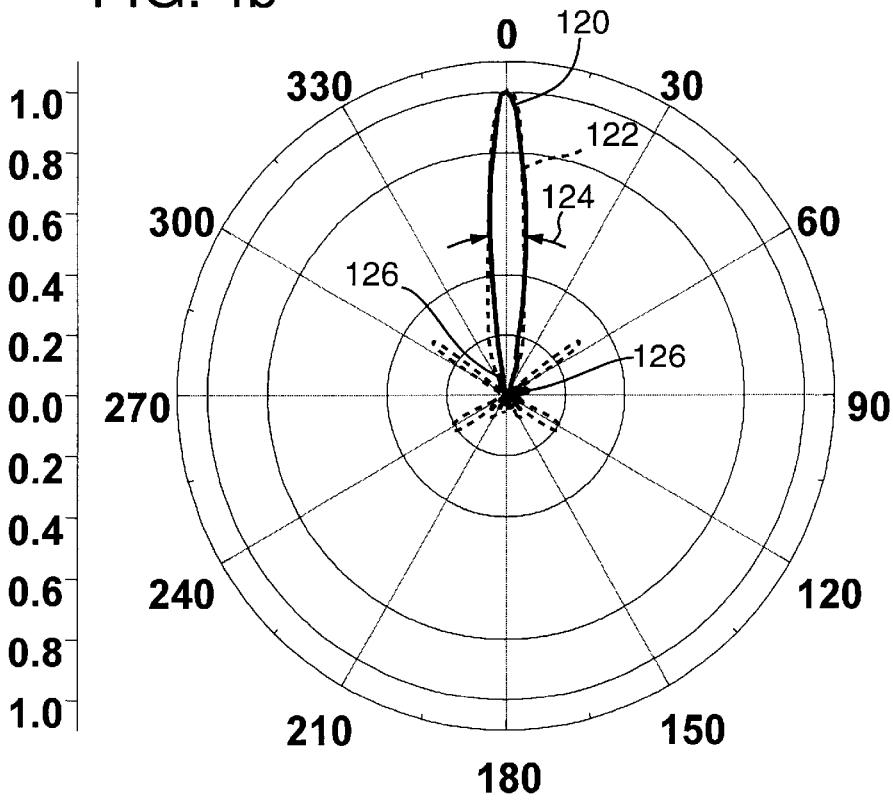
Figure 5:
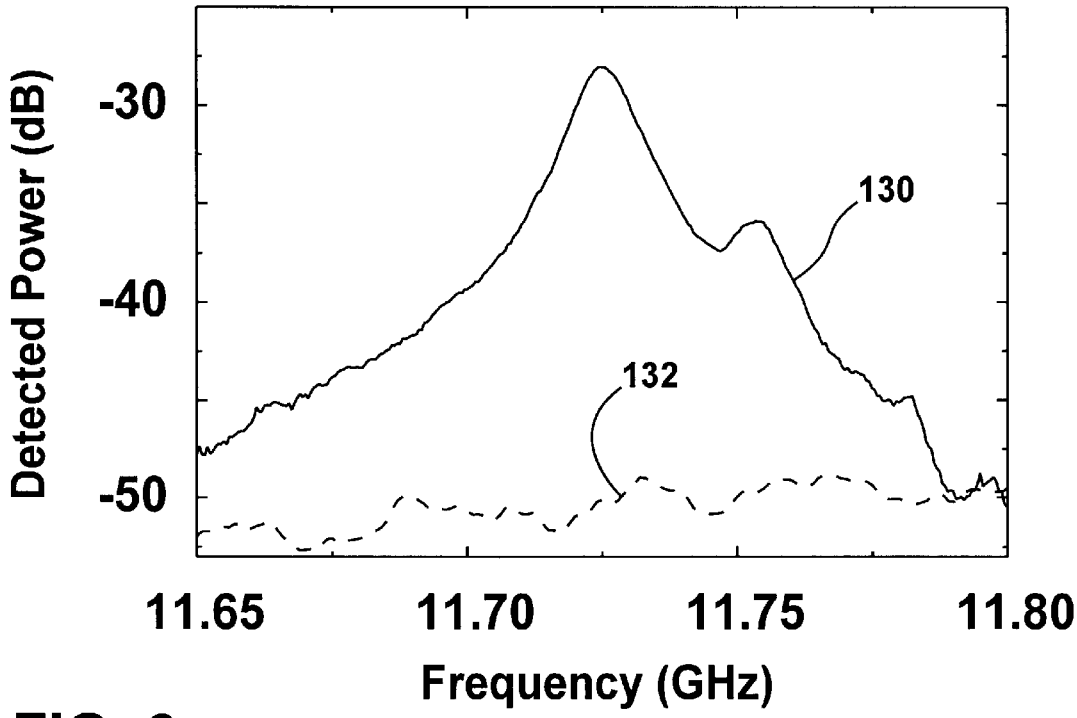
FIG. 5 is an illustration of detected power for a dielectric based photonic crystal antenna structure made in accordance with the dielectric photonic band gap structure of FIG. 2.
Figure 6:
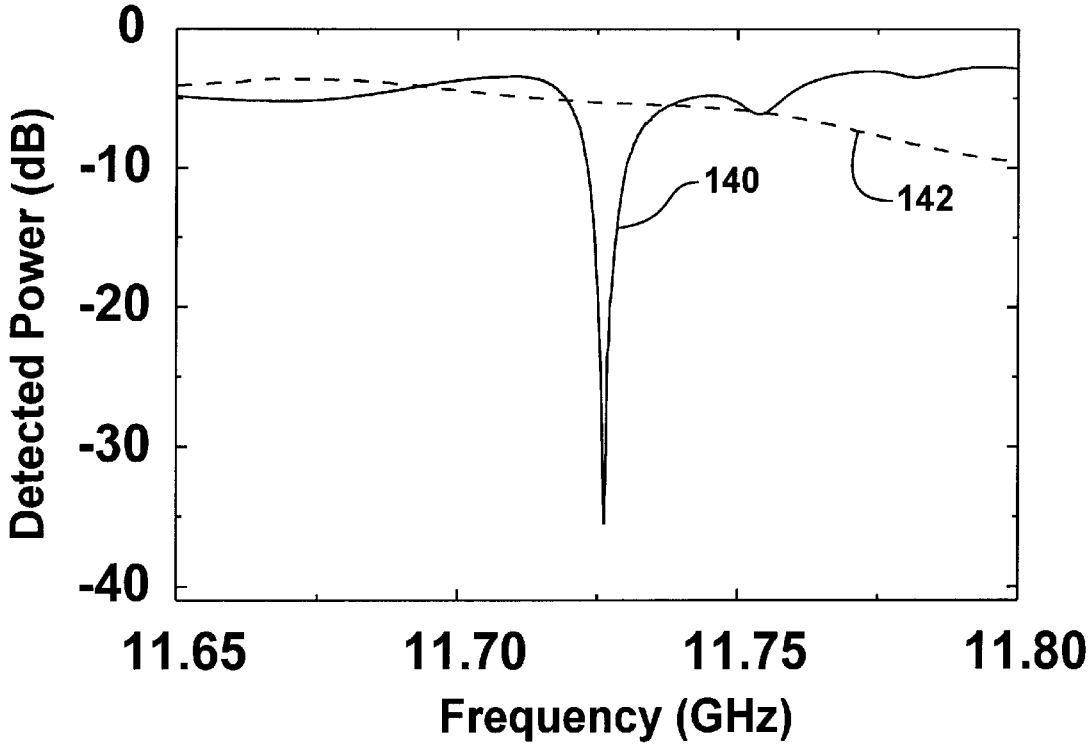
FIG. 6 is an illustration of reflected power for a dielectric based photonic crystal antenna structure made in accordance with the dielectric photonic band gap structure of FIG. 2.

FIGS. 4–6 shows measured and calculated radiation patterns, detected power and reflection power coefficient, respectively, of an antenna 50 with antenna element 52 being a monopole antenna element and the photonic crystal structures 56, 58 constructed from a twenty layer dielectric photonic crystal structure 70 having a band gap from about 10.6 GHz to 12.8 GHz with a midgap frequency around 12 GHz. The planar defect is formed by separating the 8th and 9th layers of the dielectric photonic crystal structure 70. This separation results in an asymmetric planar cavity with photonic crystal structure 56 being a two unit cell and photonic crystal structure 58 being a three unit cell. In one embodiment, the antenna element 52 is chosen to have a length that corresponds to a quarter wavelength of electromagnetic wave at a frequency near the midgap frequency of the dielectric photonic crystal structure 70. Other embodiments may have the length of antenna element 52 being a different fractional wavelength of electromagnetic wave at a frequency near the midgap frequency of the dielectric photonic crystal structure 70.

FIG. 4 illustrates measured and calculated radiation patterns in the E field and the H field. The setup for measuring the radiation patterns is illustrated in FIG. 7. In FIG. 7, the output 154 of the network analyzer 150 is connected to the antenna element 52. A receiver horn antenna 152 is connected to the input 152 of the network analyzer 150 to detect the radiation emitted from the antenna 50. The receiver horn antenna 152 is rotated around the antenna 50 to measure the radiation emitted from the antenna at incident angles of θ. For the H-plane measurements, the antenna 50 and the polarization axis of the receiver horn antenna 152 were kept vertical and were parallel to each other at all incidence angles. For the E-plane measurements, the antenna 50, photonic crystal structure 56, 58, and the receiver horn antenna 152 were rotated 90° so that the antenna 50 and the polarization axis of the receiver horn antenna 152 were horizontal.

Turning back to FIG. 4, the normalized measured radiation pattern 110 and simulated (i.e., calculated) radiation pattern 112 for the H field are shown in FIG. 4*a*. In FIG. 4*b*, the normalized radiation pattern 120 and simulated radiation pattern 122 for the E field are shown. The measured radiation pattern has a high magnitude at θ=0° and is highly suppressed along other directions in both the E plane and H plane. The radiation pattern was simulated using finite-difference-time-domain (FDTD) techniques widely used by those skilled in the art. The measured side lobes 116 have a very low radiation intensity. The simulated radiation patterns 112, 122 and side lobes 118 have a broader radiation pattern, which is due primarily to the finite time of the simulations not allowing the calculations to reach steady state. The measured half-power beamwidth 114 along the H plane is 11° and the measured half-power beamwidth along the E plane is 12°.

For antennas with a rotationally symmetric radiation pattern and having one narrow major lobe and very negligible minor lobes in the radiation pattern such as the radiation patterns 110, 120, the maximum directivity is approximately equal to:

$$D_0 \cong \frac{4\pi}{\Theta_1\Theta_2} \tag{1}$$

where $\Theta_1$ is measured in radians and is the half-power beamwidth in one plane and $\Theta_2$ is also measured in radians and is the half-power beamwidth in a plane that is perpendicular to the first plane. For the half-power beamwidth values of FIG. 4, the directivity value is approximately 310. This directivity value of 310 is significantly higher than previously measured values of around 10.

The dielectric photonic crystal structure 70 is suitable for narrow bandwidth applications. However, the defect frequency is tunable to any desired value by adjusting the width of the cavity 54. For the twenty layer dielectric photonic crystal structure 70 having a band gap from about 10.6 GHz to 12.8 GHz, the resonance frequency can be tuned within a frequency range extending from 10.6 to 12.8 GHz, which corresponds to the full band gap. The directivity dropped to values around 100 at the band edges.

FIG. 5 shows the detected power as a function of frequency at θ=0°. Line 130 is the detected power of the antenna 50 with the dielectric photonic crystal structures 56, 58. At resonance frequency, the power enhancement factor is 180 (22.6 dB) at the defect frequency of 11.725 GHz. The radiated EM field from the monopole antenna element 52 also has frequency selectivity introduced by the cavity 54. The Q factor (quality factor), which is representative of antenna losses, is defined as ratio of the peak frequency (i.e., the center frequency) to the 3 dB (half power) bandwidth of the peak frequency. Quality factor was measured to be 895. Line 132 is the detected power at the same angle with the dielectric photonic crystal structures 56, 58 removed from the antenna 50. Those skilled in the art will recognize the significant increase in power enhancement factor when the dielectric photonic crystal structures 56, 58 are part of the antenna 50.

FIG. 6 shows the measured reflection power coefficient of the antenna 50 with and without the dielectric photonic crystal structures 56, 58. Line 140 is the reflection power coefficient of the antenna 50 with the dielectric photonic crystal structures 56, 58 and line 142 is the reflection power coefficient of the antenna 50 without the dielectric photonic crystal structures 56, 58. The reflection power coefficient for the antenna 50 without the dielectric photonic crystal structures 56, 58 is −5 dB (30%). This provides an indication that the antenna 50 radiates only 70% of the incoming power. The reflection spectra of the antenna 50 with the dielectric photonic crystal structures 56, 58 shows a sharp drop of −35 dB at the resonance frequency of the cavity 54. This −35 dB drop indicates that the antenna 50 radiates 99.97% of the power input to the antenna 50. An antenna that radiates 99.97% of incoming power has a reflectivity value of 1−0.9997 0.0003.

The maximum radiation gain for the antenna 50 is related to the maximum directivity by $$G_0=(1-R)\times(1-A)^*D_0 \tag{2}$$

where R is the reflected power and A is the absorptivity of the antenna. The absorption of the antenna 50 is negligible, so the term (1−A) is neglected. The maximum gain $G_0$ has a value approximately equal to 300.

Figure 8:
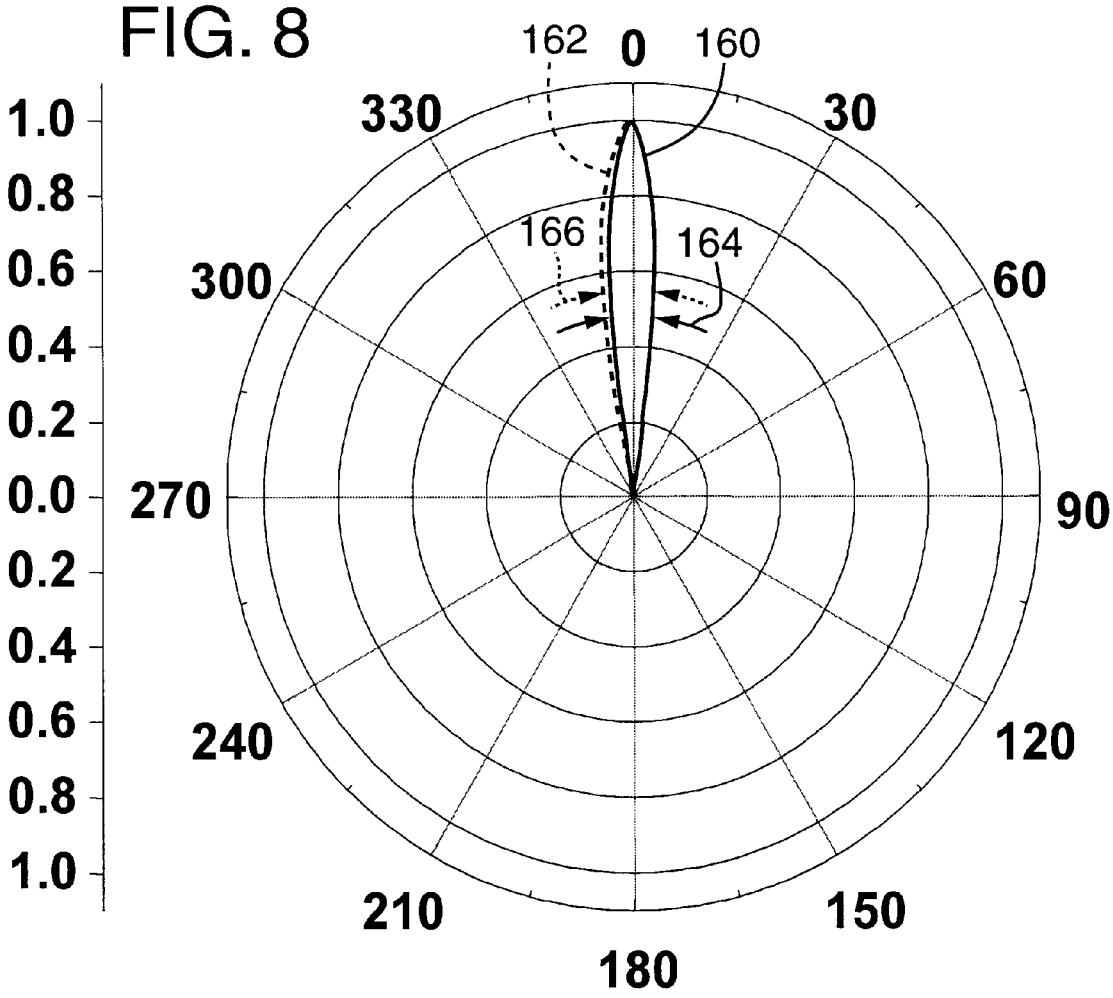
FIG. 8 is an illustration of measured radiation pattern in the H plane and the E plane for a metallic based photonic crystal antenna structure made in accordance with the metallic photonic band gap structure of FIG. 2.
Figure 9A:
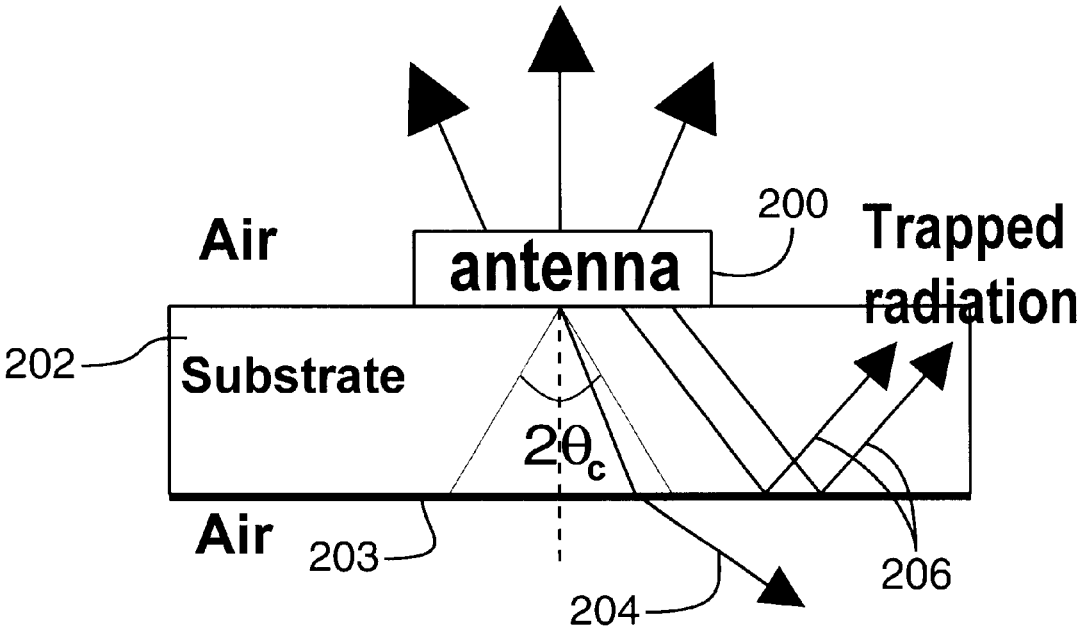
FIG. 9 is a graphical illustration of antenna radiation in an antenna mounted on a photonic crystal substrate and a non-photonic crystal substrate.
Figure 9B:
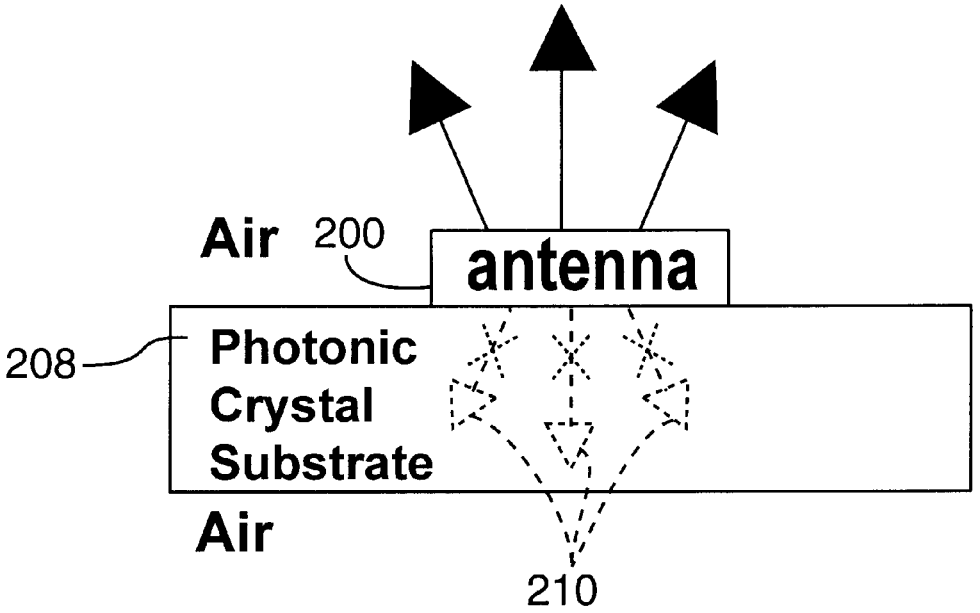

FIG. 8 shows the measured radiation pattern in the H plane and in the E plane for an antenna 50 with antenna element 52 being a monopole antenna element and the photonic crystal structures 56, 58 constructed from a ten layer metallic photonic crystal structure 90. The ten layer metallic photonic structure 90 has a periodicity of two layers and has an upper band frequency located at 20 GHz. The stop band of the metallic photonic crystal structure extends down to zero frequencies, which provides a wide range of tunability for the antenna 50. The metal rod 92 are alumina and are 0.8 millimeters (mm) wide, 2.5 mm thick, and 120 mm long and placed within the structure at a center to center separation of 7.6 mm. The planar defect is formed by separating the 4th and 5th layers of the metallic photonic crystal structure 90. This separation results in an asymmetric planar cavity with photonic crystal structure 56 being a two unit cell and photonic crystal structure 58 being a three unit cell.

The resonant frequency of the cavity 54 was adjusted to be located at a frequency of 15 GHz by adjusting the distance 60. Pattern 160 (see FIG. 8) is the radiation pattern of the antenna 50 in the H plane and pattern 162 is the radiation pattern of the antenna 50 in the E plane. The measured half-power beamwidth 164 along the H plane is 12 degrees and the measured half-power beamwidth 166 along the E plane is 13 degrees. The patterns 160, 162 have one narrow major lobe and very negligible minor lobes, so equation 1 above is used to determine the directivity. The directivity value using equation 1 is approximately 260. The reflection spectra (not shown) of the antenna 50 with the metallic photonic crystal structures 56, 58 has a drop of −23 dB at the resonance frequency of the cavity 54. This −23 dB drop indicates that the antenna 50 radiates 99.95% of the power input to the antenna 50. This high percentage indicates that the metallic photonic crystal-based antenna also has a high directivity and high gain.

A high gain, high directivity photonic crystal-based antenna has been described using both dielectric based photonic crystal structures and metallic based photonic crystal structures. Numerous modifications and alternative embodiments of the invention will be apparent to those skilled in the art in view of the foregoing description. For example, while the antenna system was described using three-dimensional antenna structures, 2 dimensional and 1 dimensional structures may be used. Accordingly, this description is to be construed as illustrative only and is for the purpose of teaching those skilled in the art the best mode for carrying out the invention. The details of the structure and architecture may be varied substantially without departing from the spirit of the invention.

What is claimed is:

1. A method of manufacturing a directional antenna using photonic band gap crystals comprising the steps of:

forming a first photonic band gap structure having a first number of layers;

forming a second photonic band gap structure having a second number of layers;

forming a resonant cavity by separating the first photonic band gap structure and the second photonic band gap structure by a predetermined distance; and placing an antenna element inside the resonant cavity.

2. The method of claim 1 further comprising the step of orienting the first photonic band gap structure and the second photonic band gap structure back to back.

3. The method of claim 1 wherein the step of forming the first photonic band gap structure comprises the steps of:

arranging a number of dielectric rods in a matrix of a material having a different and contrasting refractive index to form a plurality of planar layers;

stacking the plurality of planar layers one on the other to form a multi-dimensional structure, each layer having a plurality of dielectric rods arranged with parallel axes at a given spacing, each layer having its axes oriented at an approximately ninety degree angle with respect to its adjacent layers, alternate layers having their axes parallel to each other with the dielectric rods of one layer in offset between the dielectric rods of the other, thereby to form a three-dimensional structure of stacked layers; and selecting the spacing and dimensions of the number of dielectric rods to produce a photonic band gap at a given wavelength.

4. The method of claim 3 wherein the step of forming the second photonic band gap structure comprises the steps of:

arranging a second number of dielectric rods in a second matrix of a second material having a different and contrasting refractive index to form a second plurality of planar layers;

stacking the second plurality of planar layers one on the other to form a second multi-dimensional structure, each layer having a plurality of dielectric rods arranged with parallel axes at a given second spacing, each layer having its axes oriented at an approximately ninety degree angle with respect to its adjacent layers, alternate layers having their axes parallel to each other with the dielectric rods of one layer in offset between the dielectric rods of the other, thereby to form a second three-dimensional structure of stacked layers; and selecting the second spacing and dimensions of the second number of dielectric rods to produce a photonic band gap at a given wavelength.

5. The method of claim 4 wherein the step of placing the antenna element inside the resonant cavity includes placing the antenna element in a position that is parallel to the axis of one of the plurality of planar layers.

6. The method of claim 1 further comprising the step of selecting one of a monopole antenna element and a dipole antenna element and wherein the step of placing an antenna element inside the cavity comprises the step of placing the one of a monopole antenna element and dipole antenna element inside the resonant cavity.

7. The method of claim 6 wherein the step of selecting one of the monopole antenna element and the dipole element comprises the step of selecting one of the monopole antenna element, the dipole antenna element, a ring sector antenna element, and a circular ring antenna element.

8. The method of claim 1 further comprising the step of tuning a resonant frequency of the resonant cavity.

9. The method of claim 8 wherein the step of tuning the resonant frequency of the resonant cavity includes changing the predetermined distance.

10. The method of claim 9 wherein the step of changing the predetermined distance includes setting the predetermined distance to an integer multiple of wavelengths.

11. The method of claim 1 wherein the first number of layers is greater than the second number of layers and wherein the step of placing the antenna element inside the resonant cavity includes placing the antenna element closer to the first photonic band gap structure.

12. The method of claim 1 wherein the steps of forming the first photonic band gap structure comprises the steps of:

arranging a number of metallic rods in a matrix of a material having a different and contrasting dielectric constant to form a plurality of planar layers;

stacking the plurality of planar layers one on the other to form a multi-dimensional structure, each layer having a plurality of the metallic rods arranged with parallel axes at a given spacing, each layer having its axes oriented at an approximately ninety degree angle with respect to its adjacent layers, alternate layers having their axes parallel to each other with the metallic rods of one layer in offset between the metallic rods of the other, thereby to form a three-dimensional structure of stacked layers; and selecting the spacing and dimensions of the number of metallic rods to produce a photonic band gap at a given wavelength.

13. The method of claim 12 wherein the steps of forming the second photonic band gap structure comprises the steps of arranging a second number of metallic rods in a matrix of a second material having a different and contrasting dielectric constant to form a second plurality of planar layers;

stacking the second plurality of planar layers one on the other to form a second multi-dimensional structure, each layer having a plurality of the metallic rods arranged with parallel axes at a given spacing, each layer having its axes oriented at an approximately ninety degree angle with respect to its adjacent layers, alternate layers having their axes parallel to each other with the metallic rods of one layer in offset between the metallic rods of the other, thereby to form a second three-dimensional structure of stacked layers; and selecting the spacing and dimensions of the number of metallic rods to produce a photonic band gap at a given wavelength.

14. A directional antenna using photonic band gap structures comprising:

a first photonic band gap structure having a first number of layers;

a second photonic band gap structure having a second number of layers, the second photonic band gap structure separated from the first photonic band gap structure by a predetermined distance to form a resonant cavity; and an antenna element located in the resonant cavity.

15. The directional antenna of claim 14 wherein the first photonic band gap structure and the second photonic band gap structure are oriented back to back.

16. The directional antenna of claim 14 wherein the first photonic band gap structure has a first number of unit cells and the second photonic band gap structure has a second number of unit cells and wherein the first number of unit cells is greater than the second number of unit cells.

17. The directional antenna of claim 16 wherein the antenna element is placed at a location in the resonant cavity that is closer to the first photonic band gap structure.

18. The directional antenna of claim 14 wherein the first photonic band gap structure has a first number of unit cells and the second photonic band gap structure has a second number of unit cells and wherein the first number of unit cells is equal to the second number of unit cells.

19. The directional antenna of claim 14 wherein at least one of the first photonic band gap structure and the second photonic band gap structure comprises layers of dielectric rods stacked on top of each other, each layer having its axes oriented at approximately ninety degrees with respect to adjacent layers, alternate layers having their axes parallel to each other with the dielectric rods of one layer in offset between the dielectric rods of the other layer forming a three-dimensional structure of stacked layers, the dielectric rods arranged with parallel axes at a given spacing to form a planar layer and arranged in a material having a different and contrasting refractive index, a dimension of the rods, a spacing between the rods and a refractive contrast of the material selected to produce a photonic band gap at a given wavelength.

20. The directional antenna of claim 14 wherein at least one of the first photonic band gap structure and the second photonic band gap structure comprises layers of metallic rods stacked on top of each other, each layer having its axes oriented at approximately ninety degrees with respect to adjacent layers, alternate layers having their axes parallel to each other forming a three-dimensional structure of stacked layers, the metallic rods arranged with parallel axes at a given spacing to form a planar layer and arranged in a material having a different and contrasting refractive index, a dimension of the metallic rods, the given spacing between the metallic rods and a refractive contrast of the material selected to produce a photonic band gap at a given wavelength.

21. The directional antenna of claim 14 wherein the antenna element comprises one of a monopole antenna element and a dipole antenna element.

22. The directional antenna of claim 14 wherein the antenna element comprises one of a monopole antenna element, a dipole antenna element, a circular antenna element, and an elliptical antenna element.

23. The directional antenna of claim 14 wherein the predetermined distance is an integer number of wavelengths inside the resonant cavity.

24. The direction antenna of claim 14 wherein the predetermined distance is selected to tune a resonant frequency of the resonant cavity.

* * * * *